United States Patent [19]

Stratten

[11] 3,991,421

[45] Nov. 16, 1976

[54] PERSONAL BLAST PROTECTION ARMOR

[75] Inventor: Charles L. Stratten, Stanhope, N.J.

[73] Assignee: The United States of America as represented by the Secretary of the Army, Washington, D.C.

[22] Filed: Sept. 9, 1975

[21] Appl. No.: 611,777

[52] U.S. Cl. ..... 2/2

[51] Int. Cl.[2] ..... A41D 13/00

[58] Field of Search ..... 2/2, 3 R, 4, 5, 7, 8, 2/9, 2.5

[56] References Cited

UNITED STATES PATENTS

| | | | |
|---|---|---|---|
| 1,466,726 | 9/1923 | Meeks | 2/2 |
| 3,707,004 | 12/1972 | Kapitan et al. | 2/2.5 |
| 3,878,561 | 4/1975 | Winiecki | 2/2 |
| 3,911,914 | 10/1975 | Johansson | 2/2.5 |
| 3,922,721 | 12/1975 | Gales et al. | 2/2 |

*Primary Examiner*—G. V. Larkin

*Attorney, Agent, or Firm*—Nathan Edelberg; A. Victor Erkkila; Max Yarmovsky

[57] ABSTRACT

A plurality of interlocking reinforced barrel shaped plastic torso fitting members has a transparent vented plastic head piece threadedly connected thereto. The torso members are suspended and attached to the wearer by adjustable strapping. Compliant material is used intermediate the shock resisting members and the wearer to help position the armor on the wearer and to attenuate the transmission of blast shock waves from the armor to the wearer. The openings in the armor, to accommodate the wearer's appendages, are hermetically sealed by a lining made of rubber material. Air for breathing is brought into the helmet and exhausted therefrom by intake and exhaust check-valves which are actuated by the wearer's normal breathing.

6 Claims, 10 Drawing Figures

PERSONAL BLAST PROTECTION ARMOR

GOVERNMENTAL INTEREST

The invention described herein may be manufactured, used and licensed by or for the Government for governmental purposes without the payment to me of any royalty thereon.

BACKGROUND OF THE INVENTION

The urgent need for an effective man portable blast shield for bomb disposal personnel has escalated in recent time because of an increased use of improvised explosive devices. Various means have been used in the prior art to provide personal protective armor to those involved in bomb disposal work. However, the problem with these prior art devices was that they were primarily designed to protect against fragmentation with little or no consideration given to bodily injury resulting from blast pressure effects. The National Bomb Data Center of Picatinny Arsenal, Dover, N.J., in General Information Bulletin 73–2 dated Apr. 6, 1974 states that ear injuries may occur from blast pressures as low as 0.03 pounds per square inch and lung damage from blast pressures as low as 30 psi. With regard to lung injury, the Bulletin states:

"It is necessary for the blast shock wave to strike the chest in order to cause lung injury. Injuries occur primarily as a result of the pressure wave acting directly on the chest wall, and not normally from the pressure passing into the lungs through the air passageways. When the blast shock wave strikes the body, the chest wall is hurled violently inward and blood and other body fluids are driven into portions of the lungs which normally contain only air, thus causing hemorrhaging.

"Additionally, when the chest wall moves inward with such high velocity, the air pressure in the lungs will exceed the normal air pressure outside the body. When this occurs, the inward moving chest wall stops and is then hurled violently outward. These movements, and the speeds at which they occur, rupture the lung tissues and air is forced into the fluid carrying portions of the lungs. The degree of lung injury is therefore related to both the velocity and the amount of chest wall movement, which in turn are determined by the amount of blast pressure striking the chest wall."

The present invention is effective in substantially reducing the probability of blast pressure shock wave ear and lung injury to bomb disposal personnel. The present invention utilizes a rigid, hard, smooth shell to enclose the body air spaces in a manner that will cause a blast shock wave to travel around the outside of the shell as it passes.

SUMMARY OF THE PRESENT INVENTION

The present invention relates to a personal blast protection armor that will reduce destructive blast over pressures to an individual by a factor of at least 10 to 1. The present device is designed to cover and protect vital areas of the wearer's body such as the ears, lungs, sinus, etc., from excessive blast shock wave pressures. A two-piece barrel-shaped body member or body protector, made of such material as LEXAN or fiberglass, is contoured to present a uniformly curved surface to incident and reflected pressure waves. A head protector member comprising a circularly shaped transparent barrel form is threadedly fixed to the body protector member. A ring shaped gasket material is used intermediate the body protector and the head protector to seal the chest air space from the head protector air spaces. The openings for the arms and lower torso in the body protector are lined with rubber in order to isolate the chest and head of the wearer from direct contact with the ambient environment without unduly restricting the wearer's movement. Air intake and exhaust valves are provided at the rear of the head protector. These valves permit the wearer to utilize air from the ambient environment for breathing purposes. The wearer may also use air from a self-contained air tank for breathing which can be carried as an auxiliary back pack and connected to the inlet valve by piping.

An object of the present invention is to provide personal blast protection armor to ordnance disposal and law enforcement personnel whose duties are to deactivate improvised explosive devices.

Another object of the present device is to provide personal blast protection armor which will reduce destructive blast over-pressures than an unprotected individual will experience in the face and chest areas by a factor of 10.

Another object of the present device is to provide personal blast protection armor which will substantially reduce the possibility of ear and lung injury to the wearer exposed to an uncontrolled explosion.

A further object of the present invention is to isolate the air spaces and vital organs of bomb disposal personnel from the blast and shock wave of an uncontrolled explosion.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
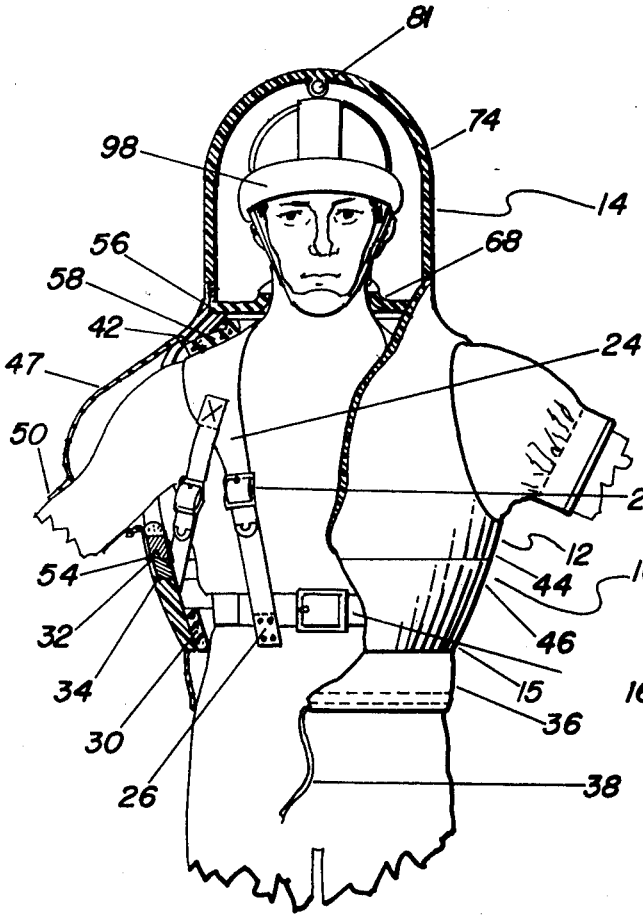
FIG. 1 is a partial cutaway front view of a person wearing the personal blast protection armor in its preferred embodiment.
Figure 2:
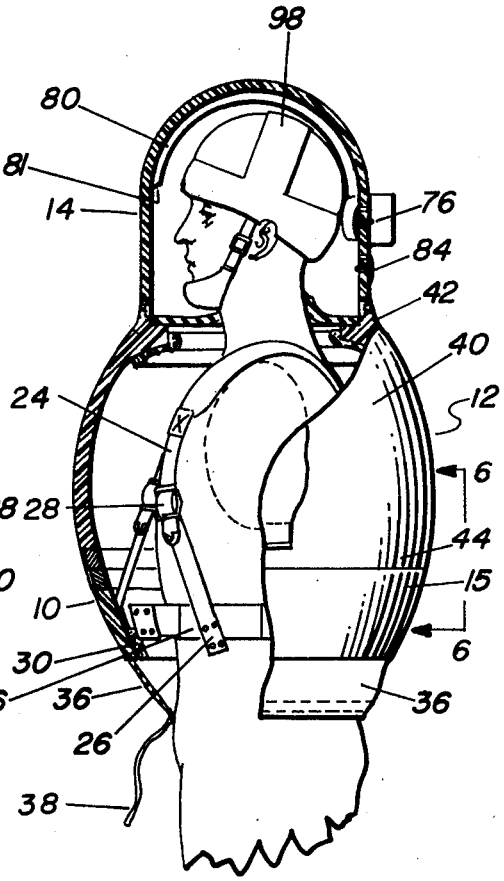
FIG. 2 is a partial cutaway side view of the personal blast protection armor and person shown in FIG. 1.
Figure 3:
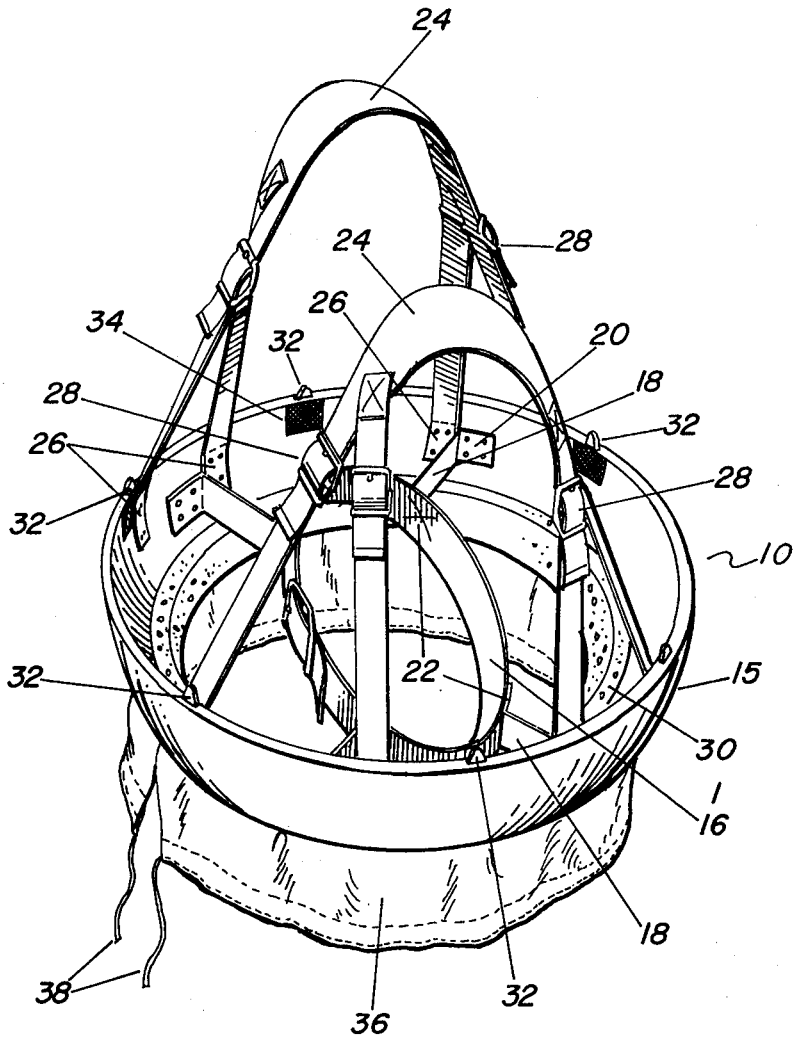
FIG. 3 is an isometric view of a lower member section of the armor showing a waist-shoulder harness connected thereto.

Referring now to FIGS. 1, 2 and 3 the blast armor is comprised of three major components, a lower waist area armor assembly 10, an upper chest armor assembly section 12, and a head protector assembly 14. The lower armor assembly 10 comprises a cylindrically shaped hollow ring member 15 made of such material as LEXAN, an adjustable waist strap 16 positioned within ring member 15 by a plurality of stand-off straps 18 which have first ends 20 fixedly attached to the interior wall of ring member 15 and the other ends 22 fixedly attached to the exterior peripheral surface of waist strap 16; a pair of strap shoulder harnesses 24 have their ends 26 fixedly attached to ring member 15 and are adjustable in length by buckles 28; a rubber strip of padding 30 is fixedly attached to the lower end interior wall surface of ring member 15; a plurality of locating studs 32 protrude upwardly from the top edge of ring member 15. A plurality of VELCRO type material adherent strips 34 are fixedly attached to the interior wall surface of ring member 15 under studs 32; and a waist skirt 36, with drawstring 38 therein, is fixedly attached to the lower peripheral edge of ring member 15, skirt 36 being made of thin flexible rubberized surgical type sheet material.

Referring now to FIGS. 1, 2, 4 and 5, the upper armor assembly 12 comprises a barrel-shaped hollow torso section 40 which has an open restricted upper head end 42 and an enlarged open lower waist end 44 which is of the same diameter as the ring member upper end 46; a pair of arm sleeves 47, made of rubberized surgical sheet, are fixedly attached to the peripheral edges of a pair of diametrically disposed arm holes 48 located on torso member 40, the lower sleeve ends 50 are lined with a rubber sleeve ring 52; the torso lower end 44 has a plurality of locating slots 54 disposed therein which are in alignment with locating studs 32; a plurality of VELCRO type adherent material flaps 55 are fixedly positioned on the interior surface of the torso member waist end 44 so that they are in alignment with the adherent strip material 34. The upper head end 42 has an integral shoulder 56 thereon which has a rubber shoulder support pad 58 fixedly attached to the underneath side of the integral shoulder 56, and an interrupted acme type neck thread 60 disposed on the interior wall 62 of the torso member head end 42.

Figure 6:
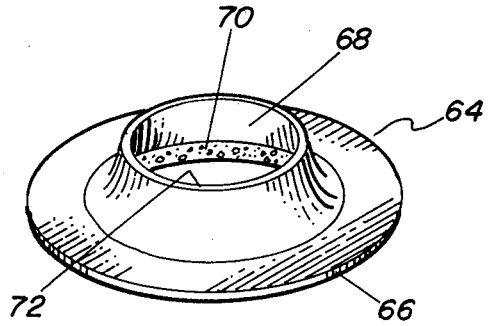
FIG. 6 is an isometric view of the neck seal assembly.
Figure 4:
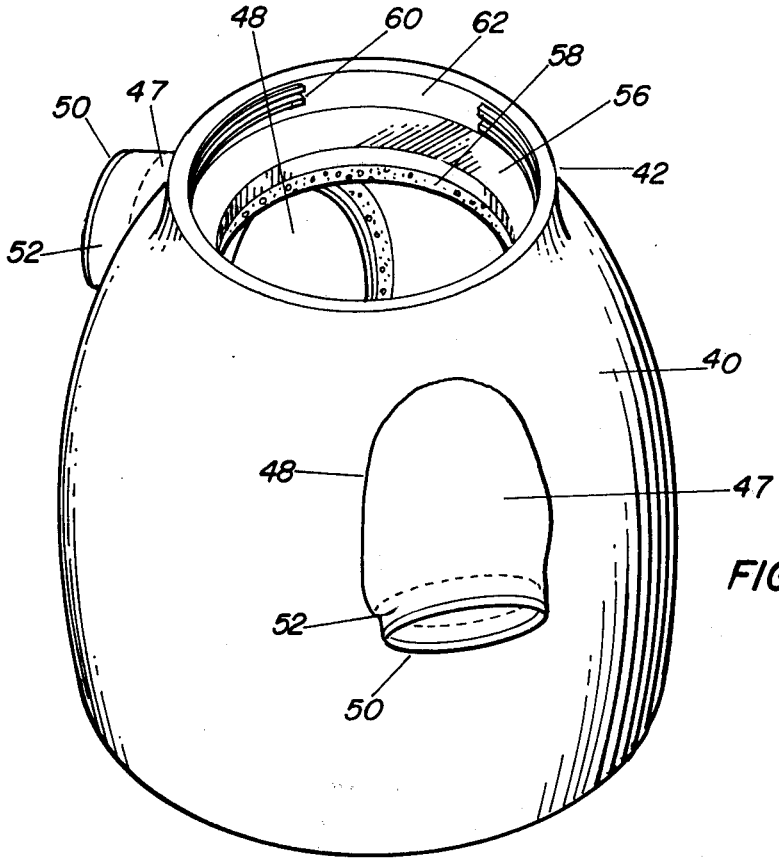
FIG. 4 is an isometric view of the upper portion of the blast protection armor.
Figure 5:
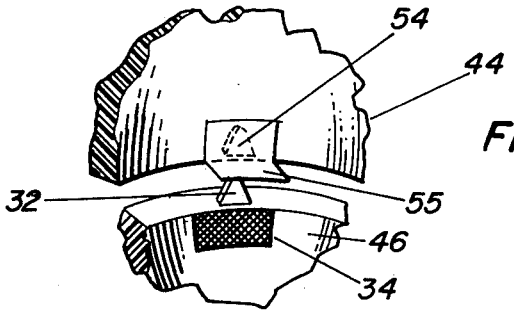
FIG. 5 is a partial cutaway isometric view taken along line 5—5 of FIG. 2.
Figure 8:
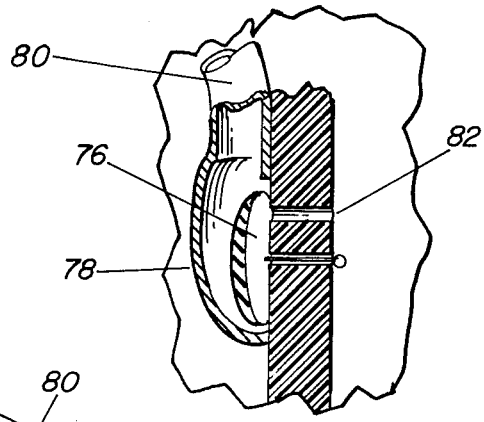
FIG. 8 is an enlarged partial cutaway view of the air inlet valve taken along line 8—8 of FIG. 7.
Figure 7:
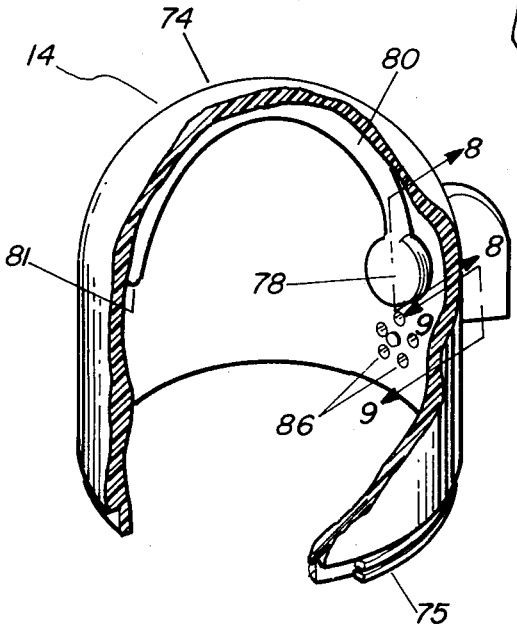
FIG. 7 is a partial cutaway isometric view of the head protector.
Figure 9:
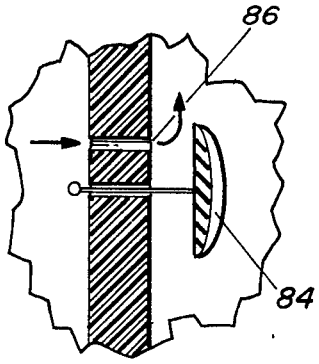
FIG. 9 is an enlarged partial cross-sectional view of the air exhaust valve taken along line 9—9 of FIG. 7.

Referring now to FIG. 6, a neck seal assembly member 64 has a flat shaped hold ring 66 which has surgical rubber neck sheet member 68 disposed intermediate the underneath side of hold ring 66 and a flat shock absorbing foam ring 70. The rubber neck sheet 68 has an axial hole 72 therein which can be stretched to slip over a wearer's head.

FIGS. 1, 2 and 7–9 illustrate a transparent helmet 74 which has an open interrupted threaded end 75 which mates with the open upper head end 42 of torso member 40. Breathing and air change within the helmet 74 are accomplished by means of an air intake valve 76, located in valve housing 78. An air pipe 80 is positioned at the interior top side of helmet 74 and communicates with intake housing 78. Valve 76 opens when the wearer is inhaling, allowing air from the outside to flow through helmet air orifices 82. During the air intake cycle, the exhaust valve 84 is closed covering a plurality of exhaust holes 86. During the air exhaust cycle, the mushroom type flapper air intake valve 76 covers the intake air orifices 82 and the used air vents through exhaust orifices 86 past exhaust mushroom type flapper valve 84. The intake and exhaust orifices 82 and 86 respectively are designed so that they are small enough in diameter to permit sufficient air to flow in and out of the head protector 14 while blocking the blast and shock wave energy.

Figure 10:
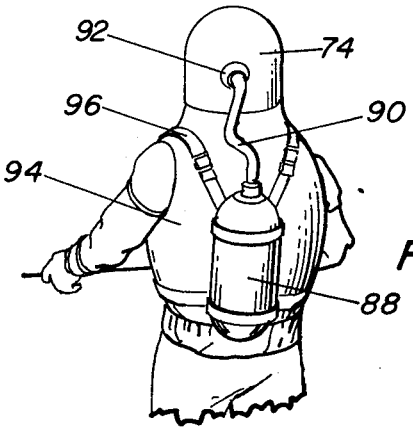
FIG. 10 is an isometric sketch of a wearer using the blast protection armor with a pressure air tank.

Referring now to FIG. 10, in an alternate embodiment, a pressurized air tank 88 or electric blower may be attached to the helmet 74 by means of pneumatic hose 90 and an air connector 92. The wearer 94 of the armor supports air tank 88 by means of straps 96.

In operation, the lower armor assembly 10, of FIG. 3, is assembled on the wearer by drawing the harness 24 and the ring member 15 up and past the wearer's hips. The shoulder harness 24 is positioned over the wearer's shoulders. The harness buckles 28 are adjusted for a comfortable fit with the bottom edge of ring member 15 positioned approximately just below the wearer's waist line. The harness straps 24 and the waist strap 16, after adjustment, provide part of the positioning stand-off support for the ring member 15 and the upper armor assembly 12 when the latter is attached to the former. Because the straps 24 and 16 have compliant characteristics, they help reduce the direct transmission of the shock impulse to the body of the wearer. This attenuation of the shock impulse is also helped because the angle of attachment of the harness 24 is generally not in line with the direction of travel of the shock impulse. After the lower protective armor 10 is comfortably adjusted, the upper armor assembly 12 is assembled by placing the lower waist end 44 over the wearer's head, his arms are then placed into sleeve arm hole openings 48 and then the assembly 12 is brought down over the wearer's body so that the locating studs 32 fit into the locating slots 54. The VELCRO type flap fasteners 55 are pressed against the VELCRO type adherent strip material 34 to securely hold the lower and upper armor assembly 10 and 12 respectively together. The drawstring 38 is brought in tight against the wearer's waist and tied to effect a seal. The neck seal assembly 64 is then placed over the wearer's head and fitted down around the neck with the holding ring 66 seated on the shoulder 56 of torso section 40. The neck seal assembly 64 purpose is to minimize shock energy transfer and to seal the head air space from the rest of the wearer's body. The head protector assembly 14 is next assembled by placing the open threaded end 75 of helmet 74 over the head of the wearer so that threaded area of the helmet 74 is in alignment with the open threaded area of the torso member head end 62. The head protector 14 is given a quarter twist about its axis to lock it securely to the torso section 40 by mating the interrupted threads of the helmet 74 with the neck threads 60 thereby sealing the neck seal member assembly 64 intermediate the helmet 74 and the torso section 40. All solid non-compliant parts of the armor are kept out of direct contact with the wearer's body, as previously described, by having compliant stand-off straps, and by having the wearer use a padded headpiece 98 as shown in FIGS. 1 and 2. Breathing and air change are accomplished by the intake valve 76 opening when taking a breath while the exhaust valve 84 remains closed. The fresh air enters through the air intake orifices 82, passes into intake housing 78 and then travels down the TYGON type air pipe 80 to the air pipe exit orifice 81 in front of the user's face, thus providing fresh air and keeping the wearer's vision area clear of fog-up. The exhaled air moves toward the back of the helmet 74 and out the air exhaust orifices 86 past exhaust valve 84. The rubber neck sheet 68 flexes with each breath and retains a minimum volume of air for comfortable breathing. In an alternate embodiment, when an air bottle of compressed air 88 is used as shown in FIG. 10, or a motorized blower, a slight continuous positive pressure is maintained within the head protector assembly 14.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention, what is claimed as new and desired to be secured by Letters Patent of the United States is:

1. Blast protection armor for bomb disposal personnel, which comprises:

means for shielding the waist area of said personnel from the blast and shock waves of an uncontrolled explosion;

means for shielding the chest area of said person from said blast and shock waves, said chest shielding means interlocking with said waist shielding means;

means for shielding the head and neck areas of said personnel from said blast and shock waves, said head and neck shielding means interlocking with said chest shielding means;

harness means for supporting said waist, chest, head and neck shielding means from the shoulders and waist of said personnel; and ventilation means for allowing said personnel to comfortably breath and see while said personnel is enclosed within said waist, chest, head and neck shielding means.

2. Blast protection armor as recited in claim 1 wherein said means for shielding said waist area comprises:

a cylindrically shaped hollow ring member;

a rubber strip fixedly attached to the interior wall surface at the lower end of said ring member;

a plurality of locating studs protruding upwardly from the top end of said ring member;

a plurality of adherent strips fixedly attached to the interior wall surface of said ring member in alignment with said studs; and a rubberized waist skirt peripherally fixedly attached to the lower end of said ring member, said waist skirt having a drawstring therein for tightening said skirt about the waist of said personnel.

3. Blast protection armor as recited in claim 1 wherein said means for shielding the chest area comprises:

a barrel-shaped hollow torso member having an open restricted cylindrically shaped upper head end and an enlarged open lower waist end, said lower waist end being of the same diameter as the upper end of said ring member, said upper end having an integral shoulder disposed therein and an interrupted thread disposed on the interior wall thereof, and a pair of diametrically disposed arm holes located intermediate said head end and said waist end, the lower waist end having a plurality of locating slots disposed therein being in alignment with said locating studs;

a pair of rubberized arm sleeves fixedly attached to the peripheral edges of said arm holes, the lower ends of said sleeves being lined on their interior wall with a rubber sleeve ring;

a plurality of adherent flaps fixedly positioned on the interior surface of the waist end of said torso member in alignment with said adherent strips of said ring member; and a rubber shoulder support pad fixedly attached to the underside of said integral shoulder.

4. Blast protection armor as recited in claim 1 wherein said means for shielding the head and neck areas comprises:

a transparent helmet having an open end which has an interrupted external thread thereon which mates with the interrupted threaded upper head end of said torso member, said helmet having a plurality of intake and exhaust orifices therethrough, said intake and exhaust orifices being of such size as to permit adequate air flow therethrough while attenuating the blast and shock wave energy of said explosion.

5. A blast protection armor as recited in claim 4 wherein said helmet is made of an impact resistant material such as LEXAN.

6. Blast protection armor as recited in claim 1 wherein said ventilation means comprises:

an air intake valve housing located within said helmet operatively positioned over said intake orifices;

an air intake valve disposed in said housing, said intake valve opening to admit air through said intake orifices when said personnel inhales and closing over said intake orifices when said personnel exhales;

an air pipe disposed in the interior top side of said helmet having an exit orifice directed to the front side of said helmet, said air pipe communicating with said valve housing; and an air exhaust valve operatively disposed over said exhaust orifices, said exhaust valve opening when said personnel wearing said armor exhales and closing when said personnel inhales.

* * * * *

UNITED STATES PATENT OFFICE
CERTIFICATE OF CORRECTION

Patent No. 3,991,421 Dated November 16, 1976

Inventor(s) Charles L. Stratton

It is certified that error appears in the above-identified patent and that said Letters Patent are hereby corrected as shown below:

The Inventor's name should read:

-- Charles L. Stratton --.

Signed and Sealed this

Twenty-second Day of February 1977

[SEAL]

*Attest:*

RUTH C. MASON
*Attesting Officer*

C. MARSHALL DANN
*Commissioner of Patents and Trademarks*